US008600557B2

(12) United States Patent
Masui et al.

(10) Patent No.: US 8,600,557 B2
(45) Date of Patent: Dec. 3, 2013

(54) EQUIPMENT ITEM MANAGEMENT SYSTEM, CONTROL METHOD THEREOF, AND EQUIPMENT ITEM MANAGEMENT APPARATUS

(75) Inventors: Hirotaka Masui, Tokyo (JP); Hidesuke Hayakawa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 705 days.

(21) Appl. No.: 12/298,639

(22) PCT Filed: Jun. 1, 2006

(86) PCT No.: PCT/JP2006/310975

§ 371 (c)(1),
(2), (4) Date: Oct. 27, 2008

(87) PCT Pub. No.: WO2007/138704

PCT Pub. Date: Dec. 6, 2007

(65) Prior Publication Data

US 2009/0099698 A1 Apr. 16, 2009

(51) Int. Cl.
*G01M 1/38* (2006.01)

(52) U.S. Cl.
USPC ..... 700/276; 700/277

(58) Field of Classification Search
USPC ..... 700/276–278
See application file for complete search history.

(56) References Cited

U.S. PATENT DOCUMENTS

| | | | | |
|---|---|---|---|---|
| 3,557,342 | A * | 1/1971 | Chambers | 219/499 |
| 5,176,006 | A * | 1/1993 | Ikawa et al. | 62/125 |
| 6,216,956 | B1 * | 4/2001 | Ehlers et al. | 236/47 |
| 7,287,393 | B2 * | 10/2007 | Kwon et al. | 62/157 |
| 7,734,572 | B2 * | 6/2010 | Wiemeyer et al. | 700/19 |
| 2003/0140637 | A1 * | 7/2003 | Masui et al. | 62/127 |
| 2010/0128691 | A1 * | 5/2010 | McFarland | 370/329 |

FOREIGN PATENT DOCUMENTS

| | | | |
|---|---|---|---|
| EP | 1 429 083 | | 6/2004 |
| JP | 59145435 | A * | 8/1984 |
| JP | 2000-111128 | A | 4/2000 |
| JP | 2003-047074 | A | 2/2003 |
| JP | 2003047074 | A * | 2/2003 |
| JP | 2003-120984 | A | 4/2003 |
| JP | 2003-176929 | A | 6/2003 |
| JP | 2005-110168 | A | 4/2005 |

OTHER PUBLICATIONS

Supplementary European Search Report dated Dec. 1, 2010, issued in the corresponding European Application No. 06747077.3-2301.

(Continued)

*Primary Examiner* — Mohammad Ali
*Assistant Examiner* — Nathan Laughlin
(74) *Attorney, Agent, or Firm* — Buchanan Ingersoll & Rooney PC

(57) ABSTRACT

A first communication section in an optical communication interface communicates with outdoor units and indoor units using a first communication method. A central management controller communicates with the optical communication interface using the first communication method and manages the outdoor units and the indoor units according to the first communication method. A second method communication section in a second communication method indoor unit of a different manufacturer communicates with a second method communication section in a second communication method outdoor unit using a second communication method. The optical communication interface and the second communication method indoor unit exchange information by optical communication with each other using respective optical communication sections.

27 Claims, 15 Drawing Sheets

(56) References Cited

OTHER PUBLICATIONS

Office Action (Notification of Reasons for Refusal) dated May 24, 2011, issued in the corresponding Japanese Patent Application No. 2008-517763, and an English Translation thereof.

*International Search Report for corresponding PCT application No. PCT/JP2006/310975, completed Aug. 2, 2006 (in English).

First Notification of Reason for Refusal issued in the corresponding Chinese Patent Application No. 200680054732.2 dated Mar. 22, 2010, and an English Translation thereof.

* cited by examiner

200: METHOD A COMMUNICATION SECTION
201a: CENTRAL PROCESSING SECTION
201b: CENTRAL PROCESSING SECTION
202a: OPTICAL COMMUNICATION SECTION
202b: OPTICAL COMMUNICATION SECTION
205b: METHOD B COMMUNICATION SECTION
205c: METHOD B COMMUNICATION SECTION
600: CENTRAL MANAGEMENT REMOTE CONTROLLER
601: STORAGE SECTION
602: COMMUNICATION SECTION
603: CONTROL SECTION
605: ELECTRIC ENERGY METER

FIG. 3

| COMMUNICATION METHOD A COMMAND | OPTICAL COMMUNICATION METHOD | |
|---|---|---|
| | CUSTOM CODE (MANUFACTURER CODE) | DATA CODE (COMMAND) |
| TEMPERATURE SETTING COMMAND A | MANUFACTURER x | TEMPERATURE SETTING COMMAND x |
| | MANUFACTURER y | TEMPERATURE SETTING COMMAND y |
| | MANUFACTURER z | TEMPERATURE SETTING COMMAND z |
| POWER ON COMMAND A | MANUFACTURER x | POWER ON COMMAND x |
| | MANUFACTURER y | POWER ON COMMAND y |
| | MANUFACTURER z | POWER ON COMMAND z |
| POWER OFF COMMAND A | MANUFACTURER x | POWER OFF COMMAND x |
| | MANUFACTURER y | POWER OFF COMMAND y |
| | MANUFACTURER z | POWER OFF COMMAND z |
| AIR VOLUME COMMAND A | MANUFACTURER x | AIR VOLUME COMMAND x |
| | MANUFACTURER y | AIR VOLUME COMMAND y |
| | MANUFACTURER z | AIR VOLUME COMMAND z |
| FAN OPERATION COMMAND A | MANUFACTURER x | FAN OPERATION COMMAND x |
| | MANUFACTURER y | FAN OPERATION COMMAND y |
| | MANUFACTURER z | FAN OPERATION COMMAND z |

200: METHOD A COMMUNICATION SECTION
201a: CENTRAL PROCESSING SECTION
201b: CENTRAL PROCESSING SECTION
202a: OPTICAL COMMUNICATION SECTION
202b: OPTICAL COMMUNICATION SECTION
205b: METHOD B COMMUNICATION SECTION
205c: METHOD B COMMUNICATION SECTION
210a: INPUT/OUTPUT SECTION
210b: INPUT/OUTPUT SECTION
600: CENTRAL MANAGEMENT REMOTE CONTROLLER
605: ELECTRIC ENERGY METER

200: METHOD A COMMUNICATION SECTION
201a: CENTRAL PROCESSING SECTION
201b: CENTRAL PROCESSING SECTION
202a: OPTICAL COMMUNICATION SECTION
202b: OPTICAL COMMUNICATION SECTION
205b: METHOD B COMMUNICATION SECTION
205c: METHOD B COMMUNICATION SECTION
600: CENTRAL MANAGEMENT REMOTE CONTROLLER
605: ELECTRIC ENERGY METER

FIG. 12

(a)

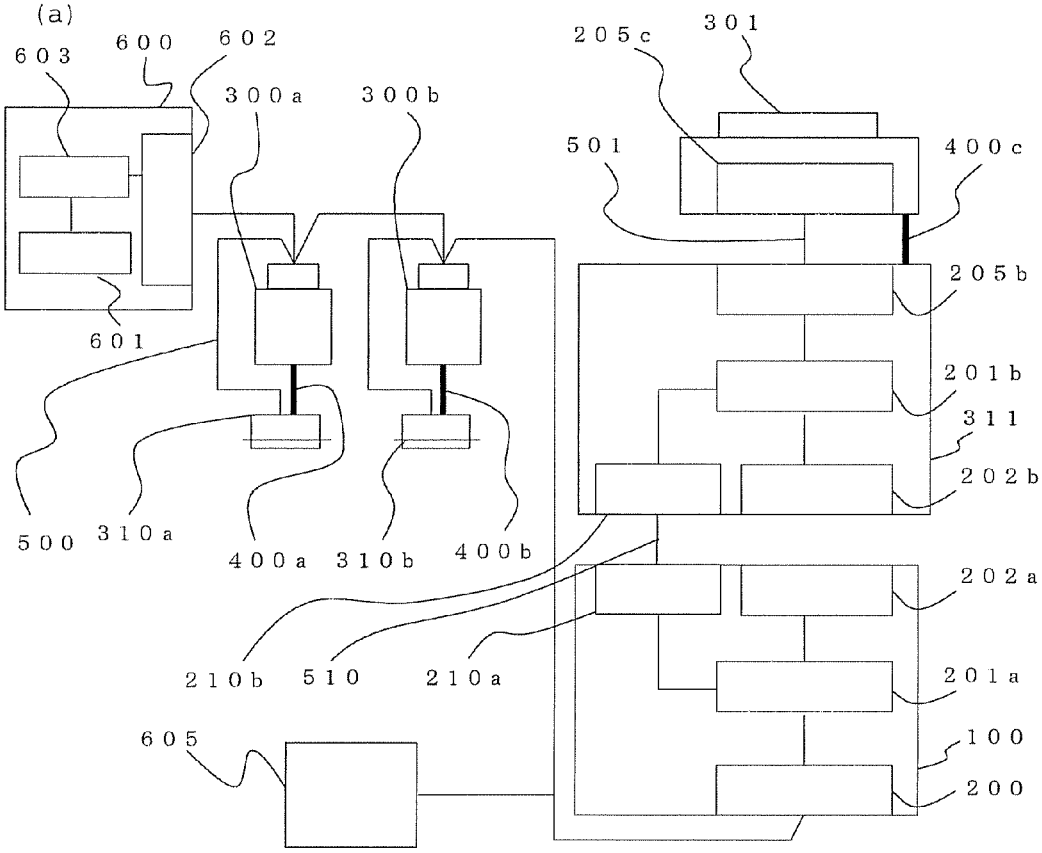

200: METHOD A COMMUNICATION SECTION
201a: CENTRAL PROCESSING SECTION
201b: CENTRAL PROCESSING SECTION
202a: OPTICAL COMMUNICATION SECTION
202b: OPTICAL COMMUNICATION SECTION
205: METHOD B COMMUNICATION SECTION
205c: METHOD B COMMUNICATION SECTION
210a: INPUT/OUTPUT SECTION
210b: INPUT/OUTPUT SECTION
600: CENTRAL MANAGEMENT REMOTE CONTROLLER
601: STORAGE SECTION
602: COMMUNICATION SECTION
603: CONTROL SECTION
605: ELECTRIC ENERGY METER (b) BUILT-IN TABLE IN CENTRAL MANAGEMENT REMOTE CONTROLLER

| MANUFACTURER IDENTIFICATION NUMBER | MANUFACTURER NAME |
|---|---|
| 0001 | ××××COMPANY |
| 0002 | ○○○○COMPANY |
| 0003 | △△△△COMPANY |
| ⋮ | ⋮ |

FIG. 14

(a)

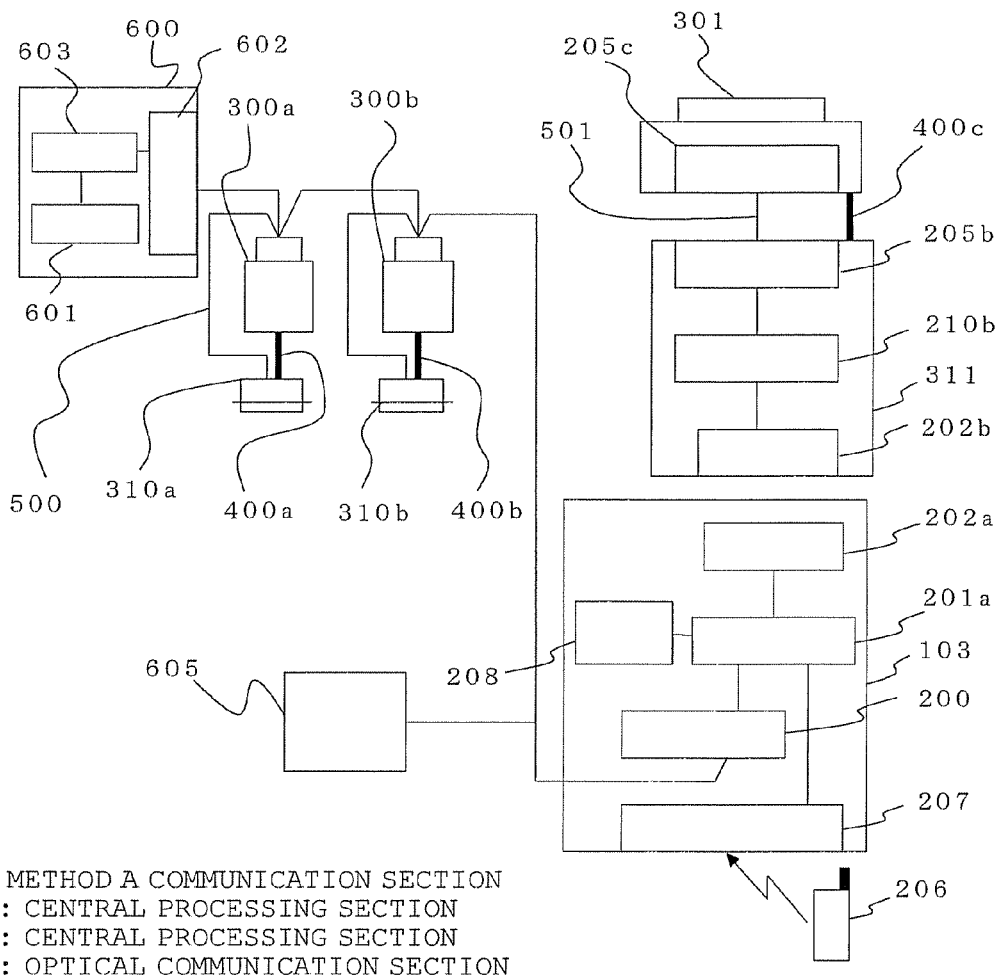

200: METHOD A COMMUNICATION SECTION
201a: CENTRAL PROCESSING SECTION
210b: CENTRAL PROCESSING SECTION
202a: OPTICAL COMMUNICATION SECTION
202b: OPTICAL COMMUNICATION SECTION
205b: METHOD B COMMUNICATION SECTION
205C: METHOD B COMMUNICATION SECTION
207: REMOTE CONTROL LIGHT RECEPTION SECTION
208: BUZZER

600: CENTRAL MANAGEMENT REMOTE CONTROLLER
601: STORAGE SECTION
602: COMMUNICATION SECTION
603: CONTROL SECTION
605: ELECTRIC ENERGY METER (b)

BUILT-IN TABLE IN CENTRAL MANAGEMENT REMOTE CONTROLLER

| EQUIPMENT ITEM NUMBER | REMOTE CONTROLLER PRIORITY INFORMATION |
|---|---|
| 1 | PRIORITIZE |
| 2 | NOT PRIORITIZE |
| 3 | PRIORITIZE |
| ⋮ | ⋮ |

201a: CENTRAL PROCESSING SECTION
201b: CENTRAL PROCESSING SECTION
202b: OPTICAL COMMUNICATION SECTION
202c: LIGHT EMITTING DIODE
205b: METHOD B COMMUNICATION SECTION
205c: METHOD B COMMUNICATION SECTION
207a: PHOTO COUPLER
208: BUZZER
600: CENTRAL MANAGEMENT REMOTE CONTROLLER
605: ELECTRIC ENERGY METER

EQUIPMENT ITEM MANAGEMENT SYSTEM, CONTROL METHOD THEREOF, AND EQUIPMENT ITEM MANAGEMENT APPARATUS

FIELD OF THE INVENTION

The present invention relates to an equipment item management system for managing, controlling, servicing, and/or maintaining equipment items such as air conditioners used in facilities such as buildings and stores. More particularly, the present invention relates to an equipment item management system for centrally controlling mixedly existing equipment items that employ different communication methods of a plurality of manufacturers, using one central management apparatus.

BACKGROUND OF THE RELATED ART

Known equipment item management systems perform central control by bus-connecting equipment items such as air conditioners that employ a unique communication method of a manufacturer. An indoor unit includes a reception section for an optical (infrared) wireless remote controller that complies with an industry standard. In response to a user's operation, the optical wireless remote controller transmits a command of an optical signal to the indoor unit. The indoor unit receives the optical signal, exchanges information with a central management apparatus that is bus-connected via a transmission line, and centrally controlled (for example, see patent document 1). A known roof-mounted air conditioner includes a light reception section on a panel surface that can be seen by users. The air conditioner can directly receive a signal from an optical wireless remote controller (for example, see patent document 2.

[Patent Document 1] Japanese Unexamined Patent Application Publication No. 2000-111128 (FIG. 1, paragraphs 0015 and 0016)

[Patent Document 2] Japanese Unexamined Patent Application Publication No. 2003-176929, (FIGS. 1 and 4, paragraphs 0013 and 0018

In the above-described equipment item management systems, most equipment items are air conditioners that employ gas heat pumps that control compressors using engines that run on gas or the like. Especially, in Japan, the air conditioners employing gas heat pumps are used in building air conditioning systems in public facilities such as hospitals and schools, family restaurants, and offices. In these facilities, as described above, the air conditioners (equipment items) are centrally controlled by a central management apparatus of the same manufacturer using a communication method unique to the manufacturer.

DISCLOSURE OF INVENTION

Problems to be Solved by the Invention

In the existing equipment item management systems, the engine-driven systems are employed. Accordingly, problems for example, wear caused by long-term use become increasingly prominent, and some of the air conditioners have broken down. Thus, it is necessary to regularly maintain the air conditioners. However, the costs are not negligible. Moreover, by the revision of the Rationalization in Energy Use Law, it is necessary to take energy-saving measures on building air conditioners to be introduced after 2000. Accordingly, it is desired to develop energy-saving and maintenance-free air conditioning devices that do not require maintenance costs.

Further, in a case where an air conditioner that employs a gas heat pump breaks down, if a high-performance, inexpensive, and new air conditioner is available, after comparing total regular running costs for maintaining the air conditioner periodically in the future with total costs (initial costs and running costs) for disposing the air conditioner and introducing an energy-saving and maintenance-free air conditioner, it is desired to introduce the new-type air conditioner.

However, it is not realistic to switch the existing air conditioners to the new-type air conditioners at a time because the initial costs are huge. Thus, it is realistic to gradually switch the existing air conditioners to the new-type air conditioners to minimize the introduction costs. In such a case, air conditioners of different communication methods of a plurality of manufacturers may exist together. In a case where new-type air conditioners of a manufacturer (A company) are centrally controlled by a central management apparatus of the same manufacturer (A company), and existing air conditioners of another manufacturer (B company) are centrally controlled by a central management apparatus of the same manufacturer (B company), the central management apparatuses of the individual manufacturers are installed. Accordingly, there are problems that it is not possible to centrally monitor failure, a wide installation space is required, and a function such as energy-saving control that both manufacturers do not commonly have can be used in only the air conditioners of one manufacturer. Accordingly, it is preferable to centrally control the existing air conditioners and the new-type air conditioners using one high-performance, energy-saving, and new-type central management apparatus.

Further, in the case where the air conditioning system including the existing and new-type air conditioners is centrally controlled using one energy-saving and new-type central management apparatus, it is not possible to manage the air conditioners by using a communication method of the other manufacturer because the communication method of the existing air conditioner management system is unique to the manufacturer and generally, the communication method is not disclosed.

Meanwhile, worldwide standards in communication methods such as BACet and Lonworks® have been known. Using such communication methods, it is possible to centrally manage set temperature change in the air conditioning system including the existing and new-type air conditioners by one central management apparatus using the common communication methods. However, the common communication methods are directed to centrally control building air conditioning management systems of a medium scale or more, and configured using advanced techniques. Accordingly, engineering loads in specification determination and local adjustment are high, and the components are expensive. Thus, the communication methods are not suitable for equipment item management systems for small-scale facilities.

Meanwhile, there has been a method in which using control panels, existing non-inverter air conditioners of different manufacturers are controlled for air-conditioning by a new-type central management apparatus by simple means. However, in this method, on the control panel, it is necessary to mount a power circuit transformer, various relays for monitoring states of the existing non-inverter air conditioners and performing start/stop control, terminal blocks, and indoor unit board. In a case where an energy-saving control is performed by only the start/stop control, the control is performed by an ON/OFF control of one contact point. Accordingly, users may be uncomfortable. Further, the frequency to apply mechanically improper force to the control panel by the ON/OFF control is high, and a life of a compressor in the air conditioner can be shortened.

An object of the present invention is to provide an equipment item management system that can centrally control equipment items using a common central management apparatus even if air conditioning equipment items of different communication methods exist mixedly.

Means for Solving the Problems

An equipment item management system according to the invention includes: one or more first air conditioners that operate according to a first communication method;

one or more second air conditioners that operate according to a second communication method different from the first communication method and include light reception means for receiving information according to an optical communication method and means for converting the information according to the optical communication method received by the light reception means into information according to the second communication method;

management means that operates according to the first communication method to manage the first air conditioner;

an interface mounted in the second air conditioners; the interface having a first communication means that receives information from the management means; and control means for converting the information received from the management means by the first communication means from the first communication method into the optical communication method;

the interface that has light transmission means for transmitting the information converted by the control means to the second air conditioner, wherein, the management means manages the second air conditioner that operates according to the different communication method via the interface. Further, an equipment item management apparatus according to the present invention includes a central controller having control means for controlling temperature of a plurality of air conditioning devices, and communication means for outputting an electric signal to a network to which the air conditioning devices are connected based on a temperature set by the control means, and an interface having reception means that is connected to the network and receives the electric signal transmitted to the network, and light output means that protocol-converts the electric signal received by the reception means and outputs the converted signal in a form of a wireless optical signal as a temperature setting command.

Further, a control method for an equipment item management system according to the present invention, in the control method for the equipment item management system having a first air conditioner that operates according to a first communication method and management means for communicating with the first air conditioner according to the first communication method and managing the first air conditioner, a second air conditioner further including communication means for communicating according to a second communication method and light reception means for receiving information according to an optical communication method is connected to the equipment item management system, and the second air conditioner is connected to the management means via the interface. The control method includes transmitting a temperature setting command for specifying a set temperature of the second air conditioner using the first communication method by the management means using an electric signal, converting the temperature setting command from the first communication method into the optical communication means and transmitting the converted command to the second air conditioner by the interface, and receiving the temperature setting command according to the optical communication command and controlling a compressor based on the received temperature setting command by the second air conditioner.

Advantages

In the equipment item management system according to the present invention, even if air conditioners of different communication methods exist together, the air conditioners can centrally be centrally controlled using a common central management apparatus.

BRIEF DESCRIPTION OF DRAWINGS

FIG. 3 is a view illustrating an example of a command conversion table recorded in a memory in an interface 100 according to the first embodiment of the present invention.

FIG.12*a* is a block diagram illustration a configuration of an equipment item management system and FIG. 12*b* is a diagram illustrating a table configuration of the central management remote controller of FIG. 12*a* according to a fifth embodiment of the present invention.

FIG. 14*a* is a block diagram illustration a configuration of an equipment item management system and FIG. 14*b* is a diagram illustration a table configuration of the central management remote controller of FIG. 14*a* according to a sixth embodiment of the present invention.

REFERENCE NUMERALS

100 optical communication interface, 101 separate type optical communication interface optical element section, 102 separate type optical communication interface body section, 103 optical communication interface, 104 optical communication interface, 200 method A communication section, 201*a, b* central processing section, 201C light emitting diode, 202*a, b* optical communication section, 205*b, c* method B communication section, 206 wireless remote controller, 207 remote control light reception section, 207*a* photo coupler, 208 buzzer, 210 input/output section, 300*a, b* communication method A outdoor unit, 301 communication method B outdoor unit, 310*a, b* communication method A indoor unit, 311 communication method B indoor unit, 400*a, b, c* refrigerant line, 500 communication method A communication medium, 501 communication method B communication medium, 502 optical element communication medium, 510 input/output signal line, 600 communication method A central management remote controller, 601 storage section, 602 communication section, 605 electric energy meter

DETAILED DESCRIPTION OF THE INVENTION

Best Modes For Carrying Out The Invention

First Embodiment

Figure 1:
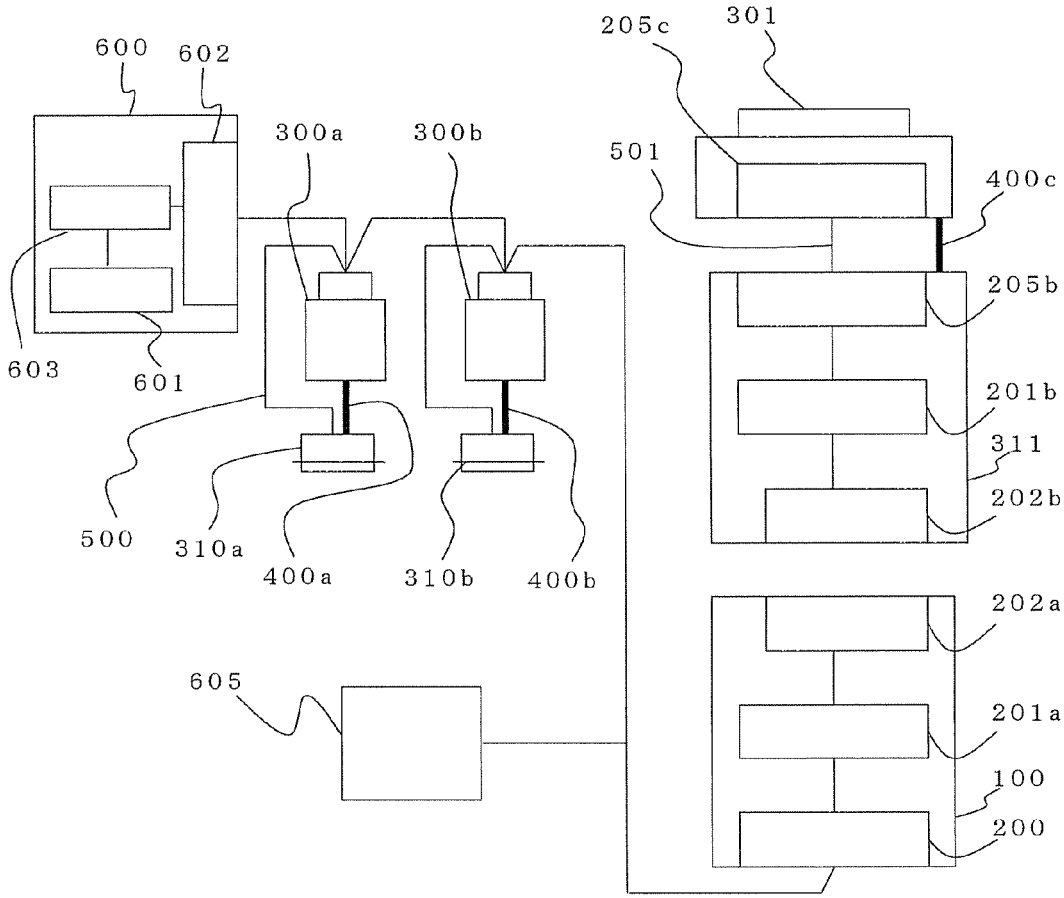
FIG. 1 is a block diagram illustrating a configuration of an equipment item management system according to a first embodiment of the present invention.

FIG. 1 is a block diagram illustrating a configuration of an equipment item management system according to a first embodiment of the present invention. In the drawing, reference numeral 100 denotes an optical communication interface, reference numeral 200 denotes a method A communication section, reference numerals 201*a* and 201*b* denote central processing sections, and reference numerals 202*a* and 202*b* denote optical communication sections. Further, reference numerals 205*b* and 205*c* denote method B communication sections, reference numeral 300*a* and 300*b* denote communication method A outdoor units (hereinafter, referred to as outdoor units 300*a* and 300*b*), reference numeral 301 denotes a communication method B outdoor unit (hereinafter, referred to as an outdoor unit 301), and reference numerals 310*a* and 310*b* denote communication method A indoor units (hereinafter, referred to as indoor units 310*a* and 310*b*). Further, reference numeral 311 denotes a communication method B indoor unit (hereinafter, referred to as an indoor unit 311), reference numerals 400*a*, 400*b*, and 400*c* denote refrigerant lines, reference numeral 500 denotes a communication method A communication medium, reference numeral 501 denotes a communication method B communication medium, and reference numeral 600 denotes a communication method A central management remote controller (hereinafter, referred to as a central controller 600). An electric energy meter 605 is connected with the central controller 600 via the communication medium 500 (network), and measures an amount of electric power consumption used in a plurality of equipment items or an entire building. The central controller 600 forms management means, and the optical communication interface 100 forms an interface. The central controller 600 and the optical communication interface 100 operate as an equipment item management apparatus that controls equipment items such as air conditioners. The outdoor units 300*a* and 300*b* and the indoor units 310*a* and 310*b* form a first air conditioner. The indoor unit 311 and the outdoor unit 301 form a second air conditioner. The optical communication section 202*b* forms optical reception means. The method A communication section 200 forms a first communication means, and the method B communication sections 205*b* and 205*c* form a second communication means. The central processing sections 201*a* and 201*b* form control means. The optical communication section 202*a* forms light wave transmission means. The communication method A is a first communication method and the communication method B is a second communication method. Both of the communication methods A and B are, for example, wire communication protocols used for building management systems and air condition management systems. The central controller 600 transmits a command for controlling a plurality of equipment items based on the communication method A to a network to which the equipment items are connected to control the plurality of equipment items. Further, the central controller 600 can display operation information of the equipment items by receiving the operation information or the like transmitted from the equipment items. The equipment items can be, for example, an air conditioner, an illumination device, an electric water heater, a ventilation device, an electric power, or the like. The central controller further includes a control section 603 that controls a plurality of equipment items based on data or a program stored in a storage section 601. The control section 603 can be a known microprocessor. A communication section 602 is a communication device that converts a command outputted by the control section 603 into an electric signal suitable for transmission of a baseband processing and outputs the converted electric signal to the network. The communication section 602 can be a known communication IC. The communication section 602 can perform, not only the above-described transmission processing, but also can perform a reception processing of data, and can inversely convert the electric signal received from the network into a digital signal that can be interpretted by the control section 603.

Now, an operation is described. The outdoor unit 301 and the indoor unit 311 connected to the communication method B communication medium 501 constitute an air conditioner of a different manufacturer that employs a communication method different from that of the central controller 600, the outdoor units 300*a* and 300*b*, and the indoor units 310*a* and 310*b* that are connected to the network of the communication method A. Generally, the manufacturers do not disclose their unique techniques. Accordingly, the manufacturer that employs the communication method A cannot obtain information about a protocol of the communication method B developed by the other manufacturer. In such a state, in order to manage air conditioner of the communication method B using the central controller 600 that employs the communication method A, a conversion interface may be provided which can convert the control signal from the communication method A into the communication method B, or from the communication method B into the communication method A. However, in a case where the communication method B is not disclosed, the other manufacturers cannot create the conversion interface.

Meanwhile, existing air conditioners of any manufacturer employ a light reception section that receives an infrared signal from a wireless remote controller. The light reception section can receive an infrared remote control signal according to the Association for Electric Home Appliances (AEHA) format that is an industry standard optical communication method, to perform control. The AEHA format has a leader section that shows start of a communication, a custom code section that defines a manufacturer code and a device code, a command data section that defines a command, and a trailer section that shows end of the communication. The data is modulated by a pulse position modulation (PPM). The AEHA format does not define specific commands to control air conditioners, and each manufacturer uniquely defines the commands. However, since the configuration of the signal is relatively simple, the commands can be readily analyzed. A common hardware for transmitting and receiving signals can be used even if the manufacturers of the air conditioners are different. Accordingly, if the custom code section of the manufacturer code or the like and the command data section are switched for each manufacturer or each air conditioner, the AEHA format can correspond to air conditioners of any manufacturer. By using the optical communication method, it is possible to set a temperature of the indoor unit 311 of the communication method B by a command from a wireless remote controller. The communication method is a one-way communication and it is not possible to inversely convert the communication methods (that is, conversion from the communication method B into an optical communication method) To solve the problem, in the first embodiment, in order to enable a plurality of air conditioners of different manufacturers that employ different communication methods to coexist at a minimum cost, an air conditioner management system is developed based on the existing optical communication interface that complies with the AEHA format. To realize the system, on the communication method A side, the optical communication interface 100 is newly provided. The optical communication interface 100 converts information according to the communication method A into information according to the optical communication method of the AEHA format, and transmits the converted information according to the optical communication method to a light reception section of an air conditioner of the other manufacturer in a form of an infrared signal from a wireless remote controller.

In view of the above-described background, an operation according to the first embodiment is described. The outdoor unit 300*a* is connected with the indoor unit 310*a* by a refrigerant line 400*a*, the outdoor unit 300*b* is connected with the indoor unit 310*b* by a refrigerant line 400*b*, and the outdoor unit 301 is connected with the indoor unit 311 by a refrigerant line 400*c*. The units transmit heat and function as air conditioners. The central controller 600 is connected with the outdoor unit 300*a*, the outdoor unit 300*b*, the indoor unit 310*a*, the indoor unit 310*b*, and the optical communication interface 100 via the communication method A communication medium 500, to exchange information. In the optical communication interface 100, when the communication method A communication section 200 receives information from the central controller 600, the central processing section 201*a* converts the information received by the communication method A communication section 200 from the communication method A into an optical communication method. An optical communication section 202*a* transmits the information converted by the central processing section 201*a* into the optical communication method in a form of an optical signal. In the indoor unit 311, when the optical communication section 202*b* receives information in the form of the optical signal, the central processing section 201*b* converts the information received by the optical communication section 202*b* from the optical communication method into the communication method B. A method B communication section 205*b* transmits the information to the outdoor unit 301 via the communication method B communication medium 501, to perform operation. In the communication using the optical signal, an optical communication method of the wireless remote controller that complies with the AEHA format is used.

Figure 2:
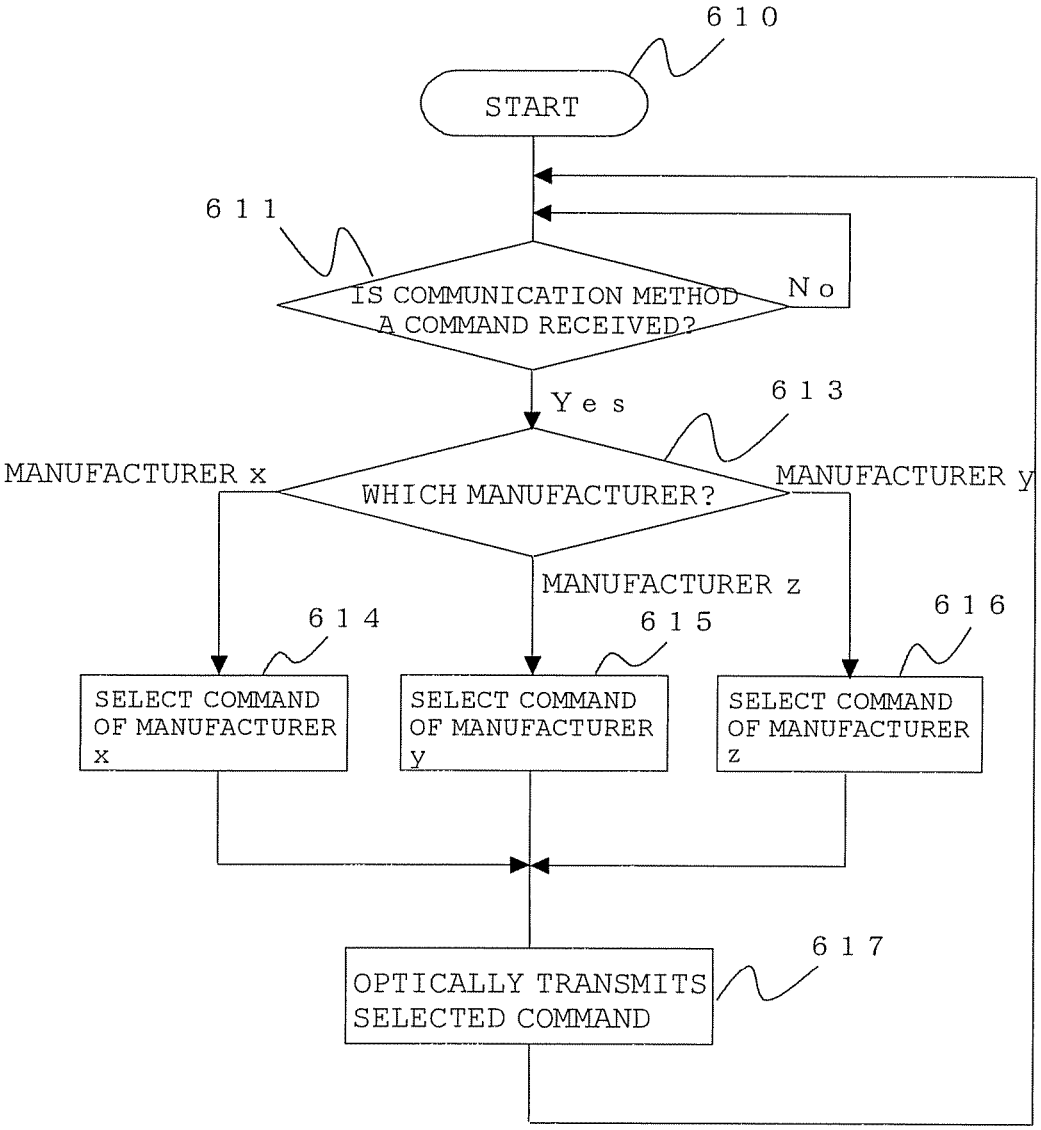
FIG. 2 is a flowchart illustrating a protocol conversion processing in a central processing section 201*a* according to the first embodiment of the present invention.

FIG. 2 is a flowchart illustrating a protocol conversion processing in the central processing section 201*a*. In response to start of a processing in the central processing section 201*a* (step S610), the central processing section 201*a* enters a state to wait for command input from the method A communication section 200 (step S611). The central processing section 201*a* receives the command from the method A communication section 200, determines a manufacturer of an air conditioner to be controlled (step S613), and selects a command appropriate for the determined manufacturer (steps 614 to 616). The manufacturer selected by the central processing section 201*a* may be selected using a DIP switch at the time of an installation of the interface 100, or stored in a memory in the central processing section 201*a* in advance. Further, as will be described in the following embodiment, the name of the manufacturer can be automatically determined by the interface 100 or the central controller 600 and stored in the memory. Thus, at the time of the determination of the manufacturer in step S613, the central processing section 201*a* can determine the manufacturer based on the manufacturer information in the memory.

FIG. 3 is a view illustrating an example of a command conversion table recorded in the memory in the interface 100. The commands according to the communication method A include a temperature setting command, a power ON command, a power OFF command, an air volume control command, a fan operation command, and the like. The memory stores commands according to the optical communication method that correspond to one communication method A command respectively for each manufacturer. For example, for a temperature setting command A according to the communication method A, a temperature setting command x for an air conditioner of a manufacturer x, is stored and similarly, for a manufacturer y and a manufacturer z, a temperature setting command y and a temperature setting command z are stored respectively. In steps S614 to 618, the central processing section 201*a* reads out a custom code and a data code corresponding to the manufacturer of the air conditioner and the command according to the communication method A from the memory. Then, the central processing section 100*a* adds data in a leader section, data in a trailer section, and parity data for parity check for respective data to the read out commands (the custom code and the data code), and outputs the data to the optical communication section 202*a* (step S617). The optical communication section 202*a* performs a PPM modulation on the commands formed by the central processing section 201*a*, and outputs the modulated command using a light emitting element such as an infrared light emitting diode (LED). In response to the completion of the command transmission in the optical communication method, the processing returns to step S611, and the central processing section 201*a* waits for an input of a next command. In a case where the temperature setting command is outputted, since the command in the communication method A includes set temperature data, the set temperature data is added to a command code to be outputted from the central processing section 201*a*, and via the optical communication section 202*a*, a set temperature is set on the indoor unit 311 side.

Energy-Saving Control

Figure 4:
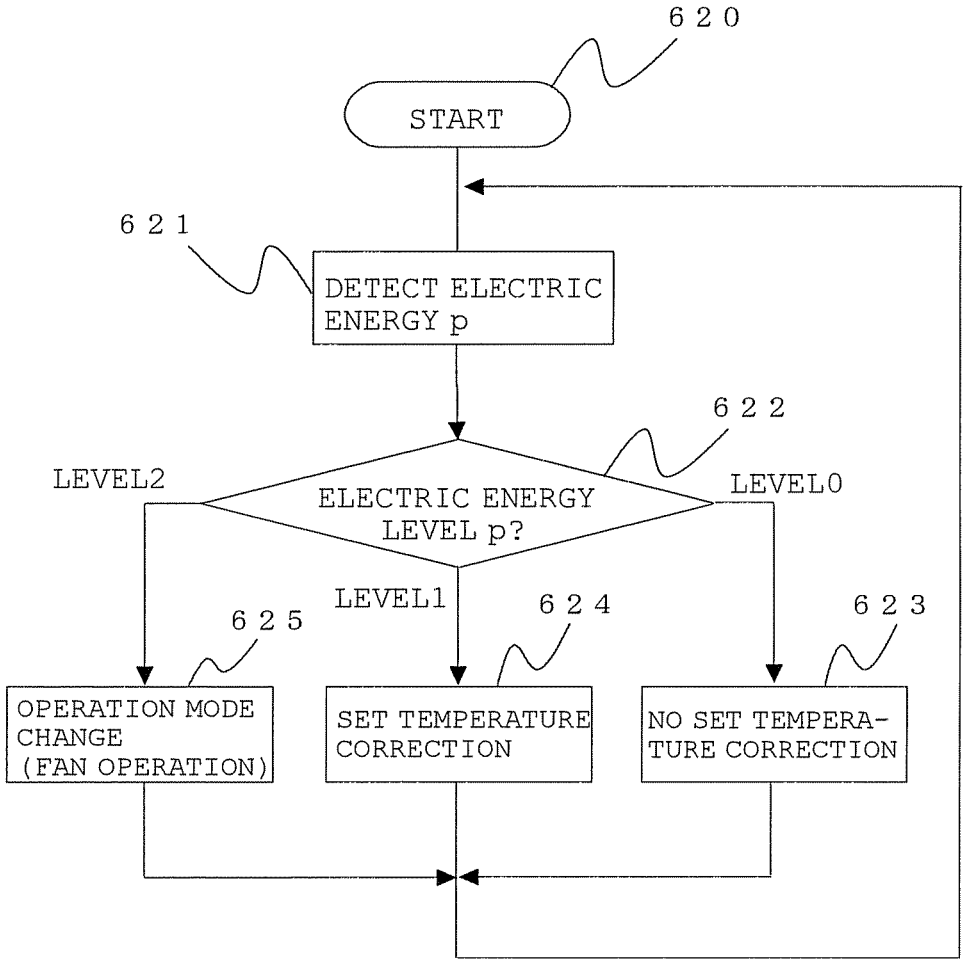
FIG. 4 is a flowchart illustrating an energy-saving control performed in a central controller 600 according to the first embodiment of the present invention.

Now, an energy-saving control performed in the central controller 600 is described with reference to FIG. 4. The central controller 600 has a function to control a set temperature and operation modes of the air conditioner depending on amounts of power consumption. In a case where an electric energy p exceeds a set value, the central controller 600 performs an energy-saving control for controlling operation of each equipment items to reduce the electric energy p. First, the central controller 600 receives data p of the electric energy measured by the electric energy meter 605 via a network (step 621). Then, the central controller 600 checks a level of the current electric energy p, and branches to a control of the air conditioner corresponding to the level (step S622). In a case where the electric energy p is a specified value P1 or less (control level 0), the central controller 600 performs an operation according to a set temperature of the air conditioner and in an operation mode (cooling operation mode, heating operation mode) set by the user in the central controller (step S623). In a case where the electric energy p satisfies specified value P1<P<specified value P2 (control level 1), the central controller 600 corrects the set temperature of the air conditioner such that the power consumption is reduced. For example, in a case where the air conditioner is operated in the cooling operation mode, the central controller 600 increases the set temperature from the set temperature that has been set by the user by a predetermined value (for example, 2 C.°) and transmits a temperature setting command to the air conditioner via a network. In a case where the air conditioner is operated in the heating mode, the central controller 600 transmits a temperature setting command for reducing the set temperature (for example, −2 C.°).

In a case where the electric energy p is the specified value P2 or more (control level 2), the central controller 600 changes the operation mode of the air conditioner, and transmits a fan operation command (step S625). That is, the central controller 600 changes the operation mode of the air conditioner from the cooling operation mode or the heating operation mode to the fan operation mode that consumes less power. However, if the cooling operation or the heating operation is changed to the fan operation, the room temperature is gradually increased. Then, if the temperature is excessively increased, some people may feel uncomfortable. To solve the problem, it is possible to control such that the concerned indoor unit can perform the fan operation only for a predetermined period (for example, six minuets) while the other indoor units are in the cooling operation. Then, after the predetermined period has elapsed, the central controller 600 switches the operation mode of the indoor unit to the cooling operation mode, and switches the operation modes of another air conditioner to the fan operation mode. Thus, the uncomfortable feeling of the user can be reduced. In a case where the indoor units 310*a*, 310*b*, and 311 are installed in one room, if the cooling operation is operated by the indoor units in turn, it is especially effective because it can be prevented that loads are concentrated on one indoor unit or a particular spot is excessively cooled.

Further, typically, in a case of large air conditioners, to one of the outdoor units 300*a*, 300*b*, and 301, the plurality of indoor units 310*a*, 310*b*, and 311 are connected via refrigerant lines. Accordingly, even if one indoor unit enters into the fan operation mode under the condition that the other indoor units are operating in the cooling operation mode, the outdoor unit continues to operate in a state that the capacity (frequency) is reduced, and a compressor can continuously operates. In a control (start/stop control) that the compressor in the outdoor unit is repeatedly started and stopped, mechanical loads are applied to the compressor and the life of the compressor may be shortened. However, by the continuous operation, the problem can be reduced. In the above-described embodiment, the energy-saving control is performed based on the electric energy. However, in the energy-saving control, set temperatures be changed depending on day or night. Further, the set temperatures can be controlled according to a program corresponding to time periods. For example, in a period of time when temperature conditions in a room get worse such as a period of time when a store is crowded, a set temperature of the cooler can be reduced, and in a period of time when the store is riot crowded, the set temperature can be increased.

As described above, in the equipment item management system according to the embodiment, information is exchanged using the equipment items having different communication methods and the optical communication means. Accordingly, the information including the set temperature can be exchanged using the optical communication data. Thus, different from the start/stop control, in the energy-saving control by set temperature change, it is possible to prevent the life of the compressor of the air conditioner from being shortened while comfortable conditions can be maintained. Further, since electric devices are used for the interface, the maintenance of the devices is not necessary. Moreover, the optical communication means can be formed of inexpensive components such as LEDs, the costs for the components for the interface are inexpensive. Moreover, since simply the interface with the optical communication means in the ceiling-mounted air conditioner is to be installed, the installation cost is not expensive. Moreover, since the central controller is dedicated to one manufacturer, engineering loads in specification determination and local adjustment are small, and the components are not expensive. Moreover, by using means or an industry standard interface provided in existing air conditioning equipment as standard equipment, the interface can be readily installed in another manufacturer's air conditioning equipment. Accordingly, as compared with a case where a communication method standard such as BACNet or Lonworks is employed, the interface for centrally controlling air conditioners using one central management apparatus can be provided at a strictly competitive price without loosing functions of the existing air conditioning equipment and without shortening the life of the air conditioners.

Second Embodiment

In the above-described embodiment 1, the information exchange with the indoor unit 311 is performed using only light. However, the communication is one-way communication from the communication method A to the communication method B via the industry-standard optical communication interface. In the communication, means to check the communication results or the like is not provided. Accordingly, if a temperature setting command is transmitted from the central controller to an air conditioner of a different manufacturer of the communication method B, it is not possible to know whether the command is accepted by the air conditioner of the communication method B or not. To solve the problem, in the second embodiment, it is described a method to centrally control air conditioners of a plurality of manufacturers that employ different communication methods, using one central management apparatus of a manufacturer at a minimum expense. As an example, it is described a case that using an HA terminal in compliance with a standard defined by Japan Electrical Manufacturers' Association (JEM standard) that is provided as an external terminal in an indoor unit of an air conditioner prevailing nationwide, the central controller 600 and an air conditioner of a different manufacturer employing the communication method B perform two-way communication by a relay contact of the HA terminal to exchange information including an ON/OFF state (start/stop state) of the indoor unit 311 and an abnormal condition signal.

Figure 5:
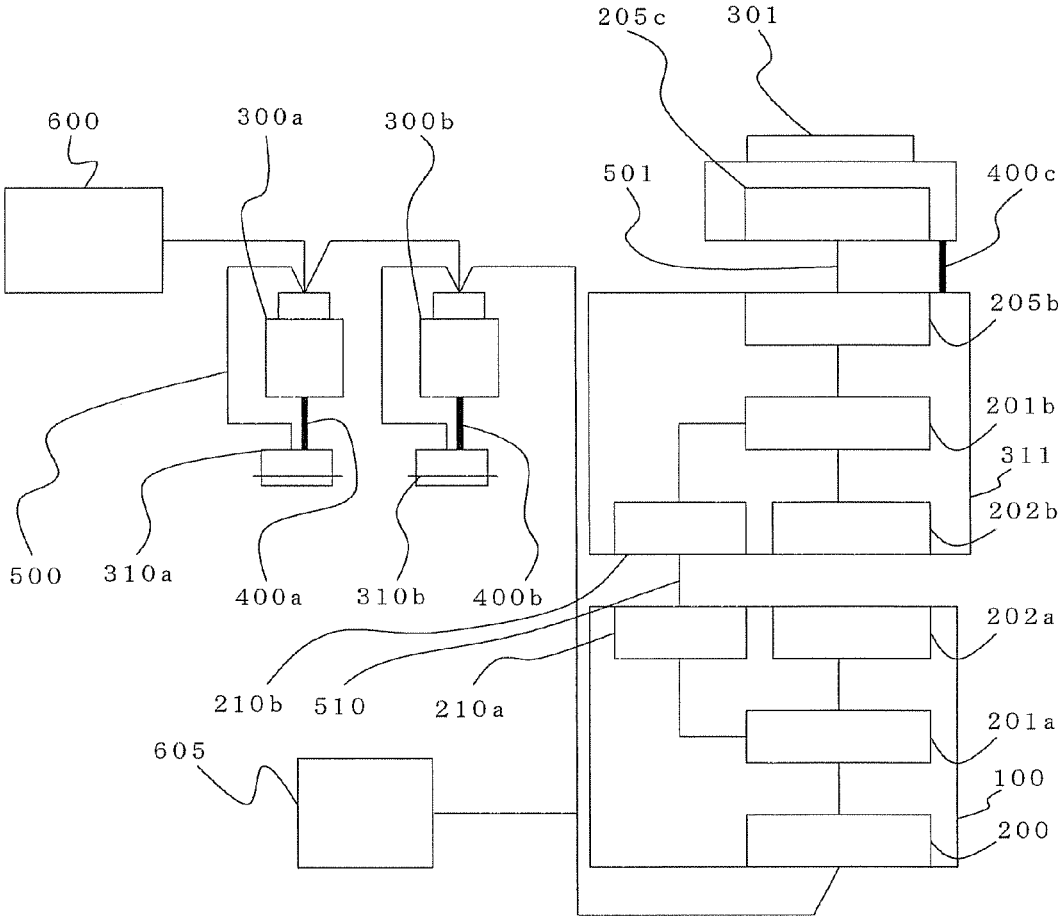
FIG. 5 is a block diagram illustrating a configuration of an equipment item management system according to a second embodiment of the present invention.

FIG. 5 is a block diagram according to the second embodiment of the present invention. The central processing section 201*b* in the indoor unit 311 determines a start/stop state of the own unit and an abnormal state including the outdoor unit 301. Then, the central processing section 201*b* transmits a message indicating the states from an input/output section 210*b* that is a standard HA terminal to an input/output section 210*a* that is a standard HA terminal in the optical communication interface 100 via an input/output signal line 510. In the optical communication interface 100, the central processing section 210*a* receives the message via the input/output section 210*a*, converts the message into a form of the communication method A, and transmits the converted message to the central controller 600 via the communication method A communication section 200 and the communication method A communication medium 500.

As described above, the central controller 600 can monitor the individual start/stop state of the indoor unit 311 and the abnormal states of the indoor unit 311 and the outdoor unit 301. In a case where the start/stop command content to the indoor unit 311 does not correspond to the content of the operation state monitor, the central controller 600 can recognize the abnormal state in the optical communication sections such as a failure, a stain, or a deviation of a communication axis in a light emitting element or a light reception element in the optical communication section 202*a* or 202*b*. In the above description, the interface 100 detects the information at the relay contact point in the HA terminal. However, if a start/stop state or an abnormal state signal or the like of the air conditioner is indicated, any signal can be used to detect the state.

Third Embodiment

Figure 6:
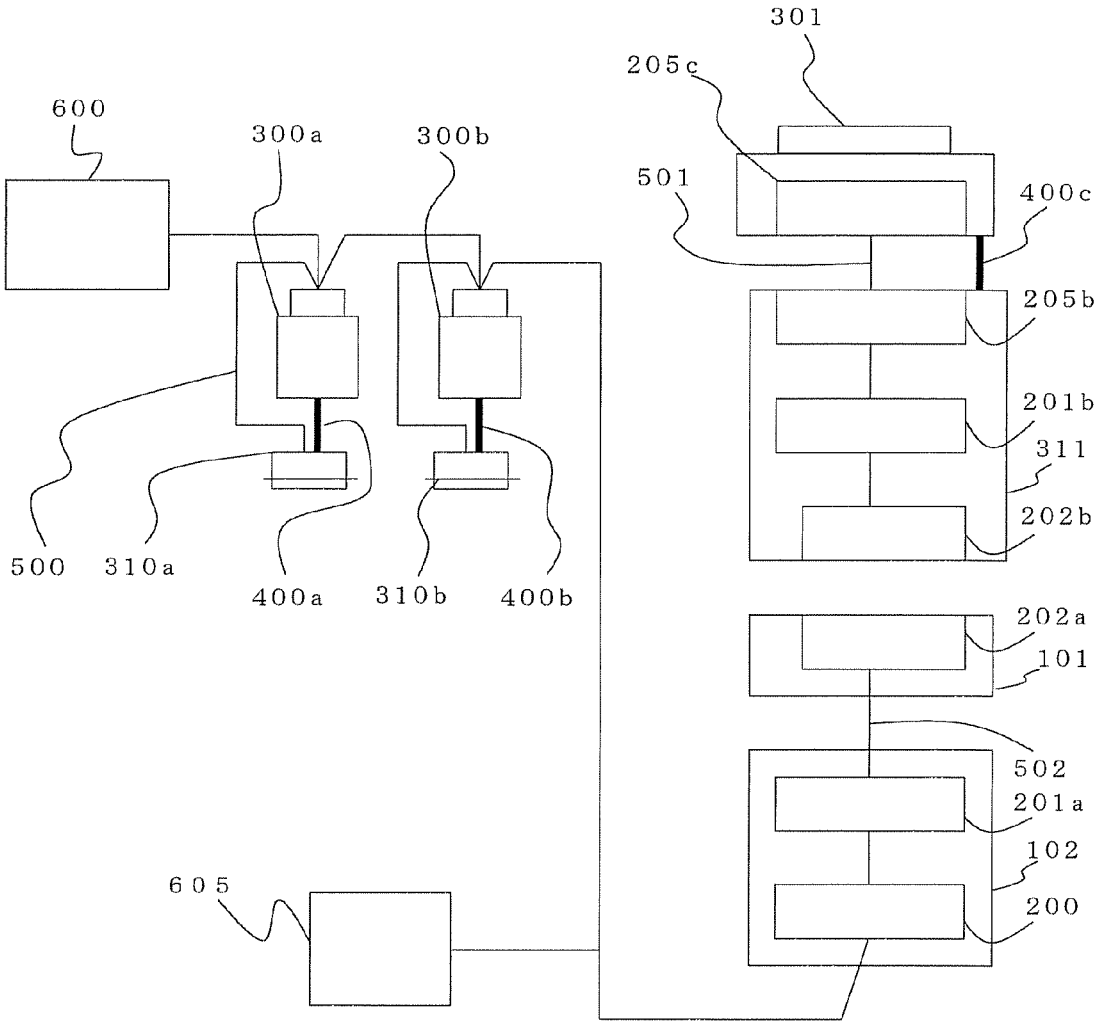
FIG. 6 is a block diagram illustrating a configuration of an equipment item management system according to a third embodiment of the present invention.
Figure 7:
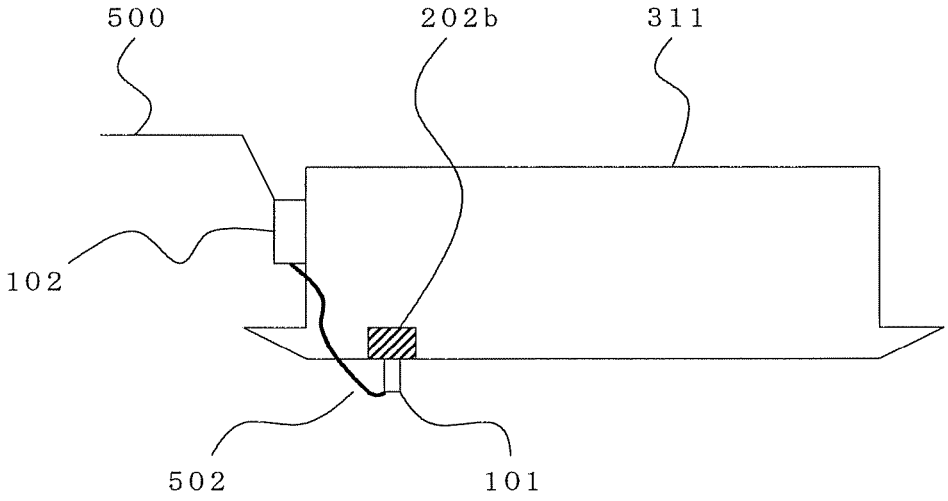
FIG. 7 is an external view according to the third and fifth embodiments of the present invention.
Figure 8:
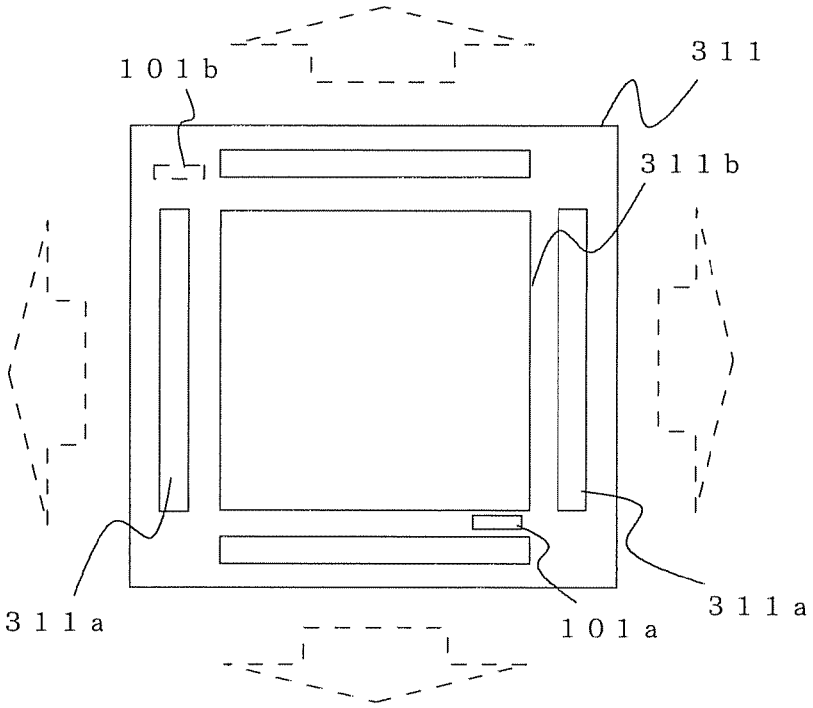
FIG. 8 is a view illustrating an under surface of an indoor unit 311 of a roof-mounted air conditioner that has air outlets in four directions according to the third embodiment of the present invention.
Figure 9:
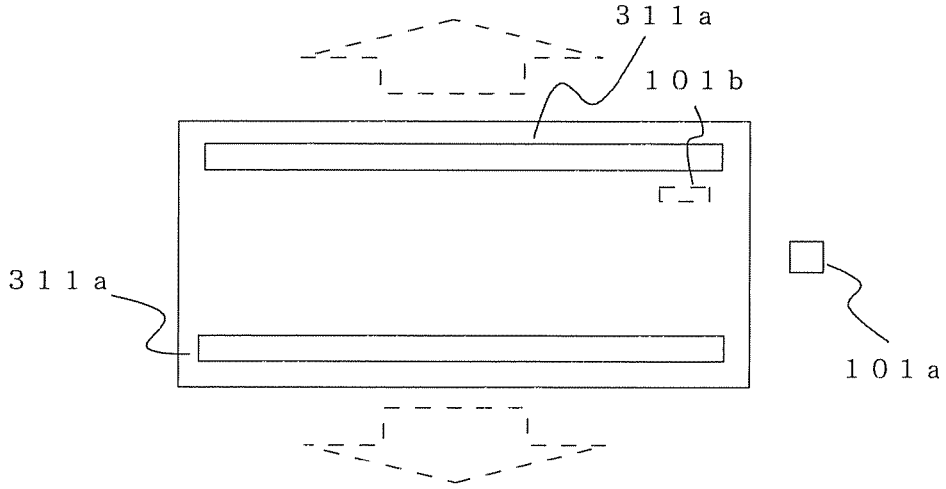
FIG. 9 is a view illustrating an under surface of an indoor unit 311*a* of a roof-mounted air conditioner that has air outlets in two directions according to the third embodiment of the present invention.

In the above-described first and second embodiments, the optical communication interface 100 is an all-in-one unit. In a third embodiment, the optical communication interface 100 can be separated into a separate type optical communication interface optical element section 101 and a separate type optical communication interface body section 102 as illustrated in FIG. 6 and FIG. 7. In FIG. 6, the optical communication section 202*a* is provided in the optical element section 101. The central processing section 201*a* and the method A communication section 200 are provided in the body section 102. The body section 102 transmits information to the optical element section 101 via an optical element communication medium 502. In FIG. 7, the inside of the optical element section 101 is installed to face the optical communication section 202*b* in the indoor unit 311. The body section 102 is installed on a side surface of the body of the indoor unit 311. FIG. 8 is a view illustrating an under surface of the indoor unit 311 of a ceiling-mounted air conditioner. The indoor unit 311 has air outlets 311*a* in four directions. An air inlet 311*b* is provided around a center section surrounded by the outlets 311*a*. The optical element section 101 (101*a*) is provided between the air outlet 311*a* and the air inlet 311*b*, and on an opposite side to a wind direction of the air outlet 311*a*. If the optical element section 101 is directly blown by cold air, dew condensation can be formed on a surface of the optical element section 101 and the light reception section 202*b*. Then, due to the dew condensation, if dust adheres on the optical element section 101*a*, an optical signal output from the optical element section 101 can be shut out, and a signal transmitted from the central controller may not be correctly transmitted to the indoor unit 311. However, by installing the optical element section 101 at the above-described position, the direct air from the air outlet 311*a* can be prevented, and the signal transmission error can be prevented. The installation position of the optical element section 100 is not limited to the above-described position, but the optical element section 100 can be installed at a position located between outlets having different blowing directions and not directly blown by cold air (for example, around a corner section of the indoor unit 311: a position indicated by reference numeral 101*b*). Similarly, as illustrated in FIG. 9, in a case where the indoor unit 311 having air outlets in two directions, the optical element section 100 can be installed at a position between outlets (see 101*b*). Further, if the optional optical communication section 202*b* is to be additionally installed, the optical element section 101*a* and the optical communication 210*b* may be externally installed on a ceiling that is not blown by cooling air.

Figure 10:
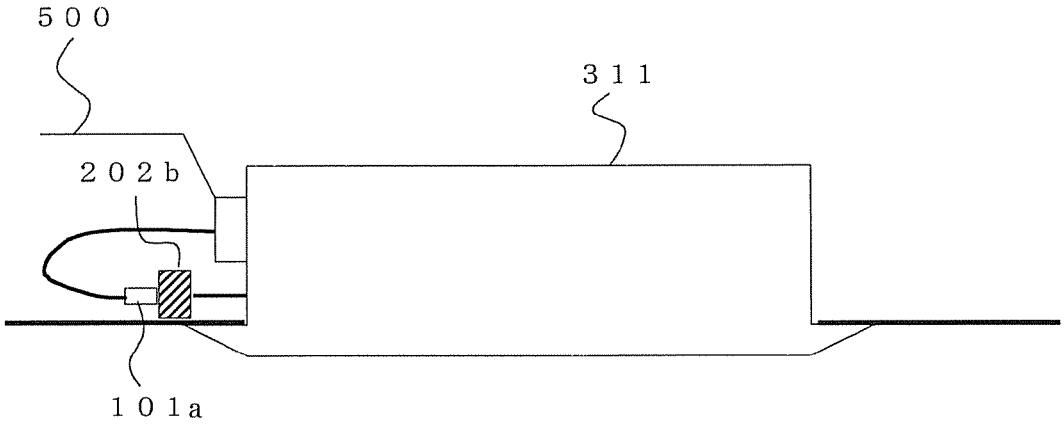
FIG. 10 is a view illustrating an example that an optical element section 101*a* and an optical communication section 210*b* are housed on a ceiling in a case where an optional optical communication section 202*b* is additionally mounted according to the third embodiment of the present invention.

As described above, the optical element section 101 that is installed at the ceiling panel section of the indoor unit 311 and formed of the light emitting diode has the small shape. Accordingly, the optical element section 101 can reduce undesirable effects on interior design to be small. Further, as illustrated in FIG. 10, in a case where the optional optical communication section 202*b* is to be additionally installed, the optical element section 101*a* and the optical communication 210*b* may be housed on a backside of the ceiling. In such a case, undesirable effects of the optical element section 101 on interior design can be eliminated.

Fourth Embodiment

Figure 11:
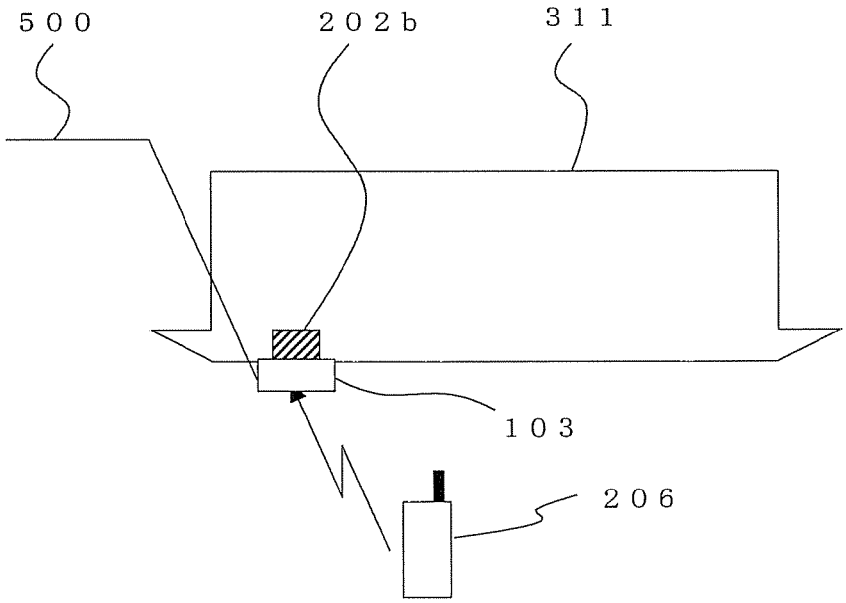
FIG. 11 is an external view according to a fourth embodiment of the present invention.

A fourth embodiment of the present invention is illustrated in FIG. 11 and FIG. 7. In the fourth embodiment, adhesion means is provided on the optical communication interface 100, the optical element section 101, and the body section 102. For example, a double-sided tape may be used as the adhesion means.

The optical communication interface 100 and the optical element section 101 are adhered and installed on the optical communication section 202*b* of the indoor unit 311. The body section 102 is adhered and installed on a side surface of the indoor unit 311. The optical communication interface 100, the optical element section 101, and the body section 102 can be readily installed in a short period of time. The optical wireless communication has directivity. However, since the parts are brought in close contact with each other, reliable communication can be performed.

Fifth Embodiment

Figure 13:
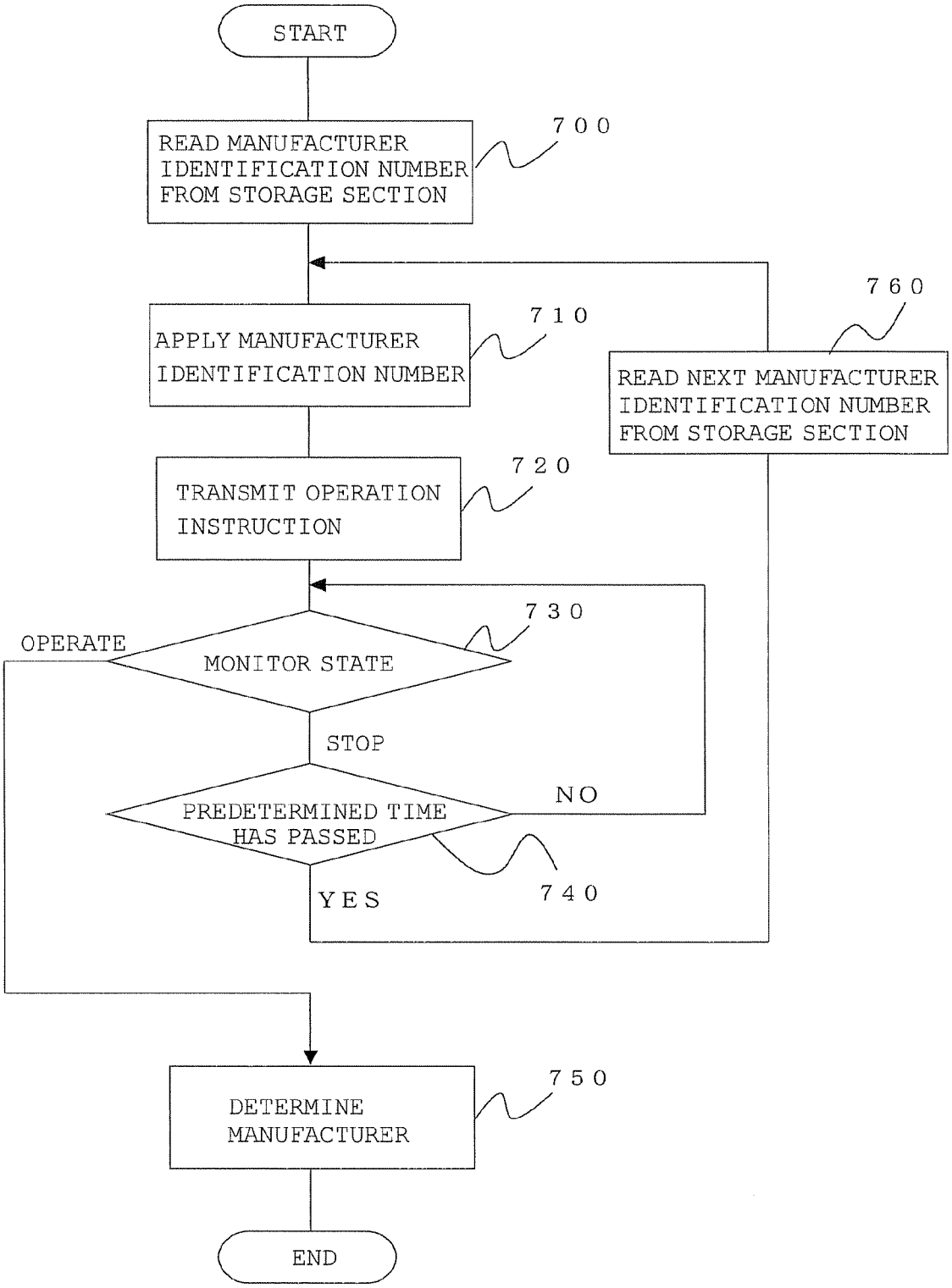
FIG. 13 is a flowchart illustrating a processing performed in an equipment item management system according to the fifth embodiment of the present invention.

In a fifth embodiment, the central controller 600 automatically identifies an optical communication command corresponding to the indoor unit 311. FIG. 12 is a block diagram illustrating a configuration of an equipment item management system according to the fifth embodiment of the present invention. As illustrated in FIG. 12, the central controller 600 includes a storage section 601 and a communication section 602. FIG. 13 is a flowchart illustrating a processing performed in the equipment item management system according to the fifth embodiment. Now, an operation according to the fifth embodiment is described with reference to FIGS. 12 and 13. In the central controller 600, a table of correspondence between manufacturer identification numbers and manufacturer names as illustrated in FIG. 12B, is registered in the storage section 601 in advance, by input/output means (not shown).

In step S700, the central controller 600 reads a manufacturer identification number from the table of correspondence between manufacturer identification numbers and manufacturer names registered in the storage section 601. In step S710, the central controller 600 applies the manufacturer identification number, and in step S720, transmits an operation command to the optical communication interface 100. The method A communication section 200 in the optical communication interface 100 receives the operation command transmitted from the central controller 600. Then, the central processing section 202*a* selects an optical communication command (power ON command) that indicates the received manufacturer identification number and a corresponding manufacturer code from the table illustrated in FIG. 3. Then, the selected power ON command is transmitted to the indoor unit 311 using the optical communication section 202*a*. The command according to the optical communication method includes the manufacturer code. Accordingly, the indoor unit 311 does not respond to a command transmitted for an air conditioner of a different manufacturer. If the indoor unit 311 receives a command that corresponds to the manufacturer, the indoor unit 311 recognizes that the command is the power ON command, and start to drive the indoor unit 311. In response to the drive of the indoor unit 311, an output of an operation state ON/OFF output terminal in the input/output section 210*b* is switched from OFF to ON. The optical communication interface 100 receives the ON signal via the input/output section 210*b* and the input/output signal line 510. Then, the central processing section 201*a* transmits an operation state monitor signal to the central controller 600 via the method A communication section 200 and the communication method A communication medium 500 to notify that the power is turned on.

When the central controller 600 receives the operation state monitor signal, the processing proceeds from step S730 to step S750. The central controller 600 decides a manufacturer name based on the manufacturer identification number at the time of the transmission. In a case where the central controller 600 determines the manufacturer name, the central controller 600 transmits a meter identification number to the interface 100 and specifies a manufacturer code to be used for transmitting a command according to the optical communication method. On the other hand, in a case where the received command does not correspond to the manufacturer identification number that is stored in advance, the indoor unit 311 does not reply to the command. Then, the operation state monitor signal is not transmitted to the central controller 600. Accordingly, the central controller 600 repeats processing in steps 740 and 730 until a certain time period has passed, and waits for an operation state monitor signal to be transmitted. After the certain time period has passed, the central controller 600 reads out a next manufacturer identification number from the storage section 601 in step S760. In step S710, the central controller 600 transmits an operation command using the manufacturer identification number and repeats the same operation.

Thus, the central controller 600 automatically identifies the manufacturer name of the indoor unit 311. Accordingly, it is not necessary to manually set the manufacturer name and wrong setting of the manufacturer name can be prevented. Accordingly, the installation can be simplified. Further, manufacturer name setting means is not necessary for the central controller 600, and the cost can be reduced. Further, it is not necessary to set the manufacturer name again when the central controller 600 is replaced. In the above description, the central controller 600 checks the manufacturer name of the indoor unit 311. However, the processing can be performed by the interface 100. That is, the interface 100 transmits the power ON commands in the table illustrated in FIG. 3 and monitors the ON/OFF output terminal of the input/output terminal 210*b*. Then, the interface 100 specifies a power ON command by which the output is switched from ON to OFF. Based on a manufacturer code included in the specified power ON command, the interface 100 specifies the manufacturer of the indoor unit 311. In the above-described embodiment, the manufacture is specified. However, in a case where commands of the optical communication method are different from each other depending on models even in the same manufacturer, device codes in addition to the manufacturer codes are included in custom codes. Accordingly, if a command of the optical communication method is provided for each device and an operation similar to the above-described operation is performed, a command of the optical communication method corresponding to the device can be automatically set to the interface.

Sixth Embodiment

In the above-described first to fifth embodiments, the central control is performed by the central controller 600. In public facilities such as a waiting room or a passage in a hospital, the central control can be performed by managing a schedule. However, for an individual classroom in a school or a private room, though the central management is generally performed, it is more comfortable air conditioned environment for users to be able to instruct temperature change by operating a wireless remote controller in a case when the users want to control air conditioners individually. In a sixth embodiment, it is described a case to use a wireless remote controller while performing the central management. FIG. 14 is a block diagram illustrating a configuration of an equipment item management system according to the sixth embodiment of the present invention. In the drawing, a wireless remote control system using a wireless remote controller is used. In the wireless remote control system, in addition to the configuration illustrated in FIG. 1, a wireless remote controller 206 used by a user is added and the optical communication interface 100 is replaced with an optical communication interface 103. The optical communication interface 103 includes a remote control light reception section 207 and a buzzer 208 in addition to the optical communication interface 100. The remote control light reception section 207 receives a temperature setting command transmitted from the wireless remote controller 206, converts the command into a signal that can be processed in the central processing section 201*a*, and transmits the signal to the central processing section 201*a*. In response to an instruction signal transmitted from the central processing section 201*a*, the buzzer 208 outputs a low sound that indicates reception rejection and a high sound that indicates reception completion. The remote control light reception section 207 includes a light reception section that receives a wireless signal (an optical signal such as an infrared light) including the temperature setting command transmitted from the wireless remote controller 206, a light/electricity conversion section that converts the light signal received by the light reception section into an electric signal, and an A/D conversion section that converts the converted electric signal from the analog signal into a digital signal. In response to a reception of an instruction signal from the central processing section 201*a*, the buzzer 208 determines whether the reception of the signal is faulty reception or the reception completion. If the signal is faulty reception, the buzzer 208 reads out a low-pitched sound signal (for example, a low-pitched sound such as a shaking sound) that is stored in a storage section in advance, from the storage section and outputs the low-pitched sound signal to a speaker. If the signal is reception completion, the buzzer 208 reads out a low-pitched sound signal (for example, a high-pitched sound such as "pip") that is stored in the storage section in advance, from the storage section and outputs the high-pitched sound signal to the speaker.

Figure 15:
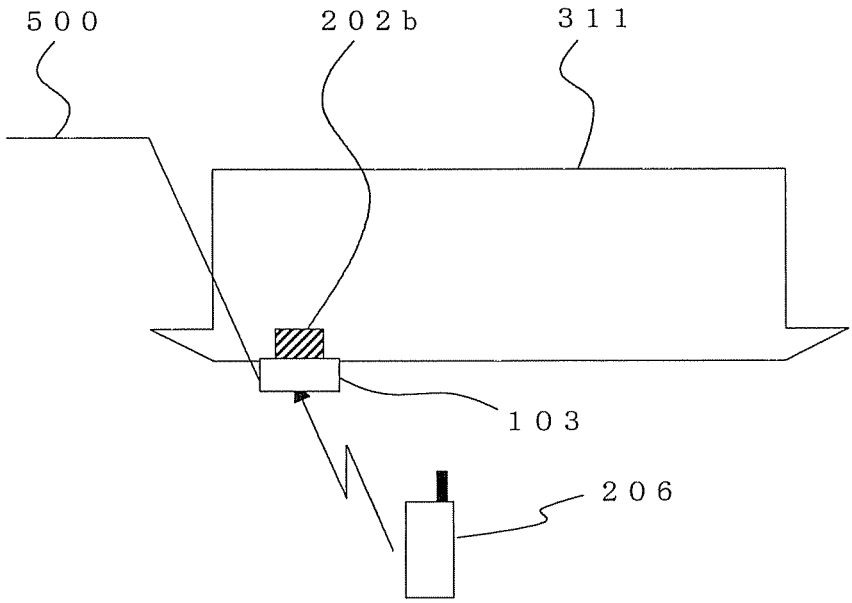
FIG. 15 is an external view of the equipment item management system in FIG. 14.

The above-described optical communication interface 103 is installed near the optical communication section 202*b* in the indoor unit 311 as illustrated in FIG. 15. When the optical communication interface 103 is installed on the optical communication section 202*b* in the indoor unit 311 of the communication method B, in order that the optical communication section 202*b* receives only a light signal transmitted from the optical communication section 202*a* of the optical communication interface 103 but does not receive the other light signal, for example, a light signal transmitted from the remote controller 206, the optical communication section 202*a* is moved closer to the optical communication section 202*b* and fixed. Then, a light-proof cover is installed on the optical communication section 202*b* (light reception section) of the indoor unit. The cover opens such that the cover mounts and fixes the optical communication section 202*a* that is a light emitting section on the inside of the cover at one end and encases the optical communication section 202*b* that is a light reception section of the indoor unit 311 at the other end. In the installation, to prevent light from entering into the optical communication section 202*b* from the environment through a gap at the part where the cover is mounted, the space of the cover mounted part is securely sealed with black cloth or a black vinyl tape.

Now, an operation performed in the sixth embodiment is described. The central processing section 201*a* receives a temperature setting command that is received from the wireless remote controller and digitized by the D/A conversion section and compares the information with an upper limit and a lower limit that are registered in advance. Then, the central processing section 201*a* checks whether the temperature setting command exceeds the upper limit threshold or the lower limit threshold or not. In a case where the temperature setting command exceeds either of the thresholds, the central processing section 201*a* instructs the buzzer 208 to emit the reception failure sound indicating that the command is not received because of abnormality. In a case where the temperature setting command is between the upper limit and lower limit, the central processing section 201*a* instructs the buzzer 208 to emit the reception completion sound indicating that the command is normally received and transmits the received temperature setting command to the central controller 600 via the method A communication section 200. Then, based on the table illustrated in FIG. 3, the central processing section 201*a* performs conversion from the temperature setting command of the optical communication method into the temperature setting command of the communication method A, and transmits the converted command to the central controller together with an identification number that specifies the indoor unit 311. The buzzer 208 receives the instruction signal from the central processing section 201*a*. In a case where the signal is reception failure, the buzzer 208 reads out the low-pitched sound signal (for example, low-pitched sound such as a shaking sound) that is stored in the storage section in advance from the storage section and outputs the low-pitched sound signal to the speaker. If the reception of the signal is reception completion, the buzzer 208 reads out the relatively high pitched sound signal (for example, a high-pitched sound such as "pip") that is stored in the storage section in advance from the storage section and outputs the high-pitched sound signal to the speaker. Accordingly, the user can determine whether the command is accepted or not. In the case where the command is not accepted because of the reception failure, the user can respond to the reception failure by transmitting the command again from the remote controller or the like.

Meanwhile, in the case of the reception completion, the temperature setting command and the indoor unit identification number transmitted from the central processing section 201*a* via the method A communication section 200 are transmitted to the central controller 600 via the communication medium 500. In response to the reception of the temperature setting command of the wireless remote controller and the indoor unit identification number from the optical communication interface 103 via the communication medium 500 through the communication section 602, the central controller 600 refers to a table of correspondence between indoor unit identification numbers and information whether to prioritize wireless remote controller information, as shown in FIG. 14B, the table being registered in a storage section 601. Then, based on the table and the received indoor unit identification number, to the corresponding indoor unit, the central controller 600 determines whether to validate or invalidate the temperature setting command transmitted from the wireless remote controller. In a case where the temperature setting command from the wireless remote controller is prioritized, the central controller 600 validates the temperature setting command specified by the wireless remote controller, transmits the temperature setting command and a indoor unit identifier to the communication medium 500 again, and stores the set temperature in the own storage section to use the set temperature for future set temperature control. In a case where the temperature setting command from the wireless remote controller is not prioritized, the central controller 600 invalidates the temperature setting command specified by the wireless remote controller. Then, the central controller 600 transmits a message signal indicating that the temperature setting command from the central controller 600 and the temperature setting command from the wireless remote controller are rejected to the communication medium 500. In a case where the temperature setting command and the indoor unit identification number transmitted via the communication medium 500 correspond to an indoor unit of the method A, the temperature setting command is directly accepted in the indoor unit and an operation is performed to obtain the set temperature. In a case where the indoor unit corresponds to the method B, in the optical communication interface 103 in the corresponding indoor unit, when the central processing section 201*a* receives the temperature setting command from the central controller 600 via the communication medium 500 and the method A communication section 200, the central processing section 201*a* D/A converts the temperature setting command, further converts it from the electric signal into an optical signal, and transmits the signal from the optical communication section 202*a* to the optical communication section 202*b* in the indoor unit 311. The following processing is similar to that in the first embodiment. In a case where the central processing section 201*a* receives the message signal indicating that the temperature setting command from the wireless remote controller is rejected, the central processing section 201*a* instructs the buzzer 208 to emit an alarm sound indicating that the temperature setting command from the wireless remote controller is rejected. In response to the instruction signal, the buzzer 208 reads out a relatively low-pitched sound signal (for example, a buzzing sound) that is stored in advance from the storage section and outputs the sound signal to an alarm device such as a speaker. Accordingly, the user can understand that the signal from the wireless remote controller is accepted, but, the room which the user is in is under the central control, and it is not possible to control the room using the wireless remote controller.

According to the sixth embodiment, only by setting whether to set the setting of the indoor unit to give priority to the wireless remote controller or not, the temperature control corresponding to requests from users in addition to the temperature setting command managed by the central controller 600 can be performed for each indoor unit including an indoor unit of different manufacturer. Accordingly, for example, it is possible to make temperature control using the wireless remote controller always valid in a certain room, and to make the temperature control invalid for a certain period of time in all the other rooms.

In the embodiment, the central controller 600 determines whether to validate or invalidate the temperature setting command transmitted from the wireless remote controller. However, in stead of the central controller 600, the central processing section 201*a* in the optical communication interface 103 can perform the determination. In such a case, the central processing section 201*a* registers the temperature setting command transmitted from the central controller 600 and information whether to prioritize wireless remote controller information in advance in a storage section (not shown). In response to a reception of the temperature setting command from the wireless remote controller 208, the central processing section 201*a* reads out the information indicating whether to prioritize the wireless remote controller information or not from the storage section, and determines whether to validate or invalidate the temperature setting command transmitted from the wireless remote controller. In a case where the temperature setting command from the wireless remote controller is prioritized, the central processing section 201*a* validate the temperature setting command specified by the wireless remote controller and transmits the temperature setting command to the optical communication section 202*b* in the indoor unit 311 of the method B via the optical communication section 202*a*. In a case where the temperature setting command from the wireless remote controller is not prioritized, the central processing section 201*a* may or may not transmit the stored temperature setting command from the central controller 600 again the temperature setting command to the optical communication section 202*b* in the indoor unit 311 of the method B via the optical communication section 202*a*. The set information is transmitted to the central controller 600. The central controller 600 stores the information in the storage section for management. As described above, similar effects to the above-described effects can be obtained, and further, the processing speed can be increased, since the two-way communication between the optical communication interface 103 and the central controller 600 is not necessary.

Figure 16:
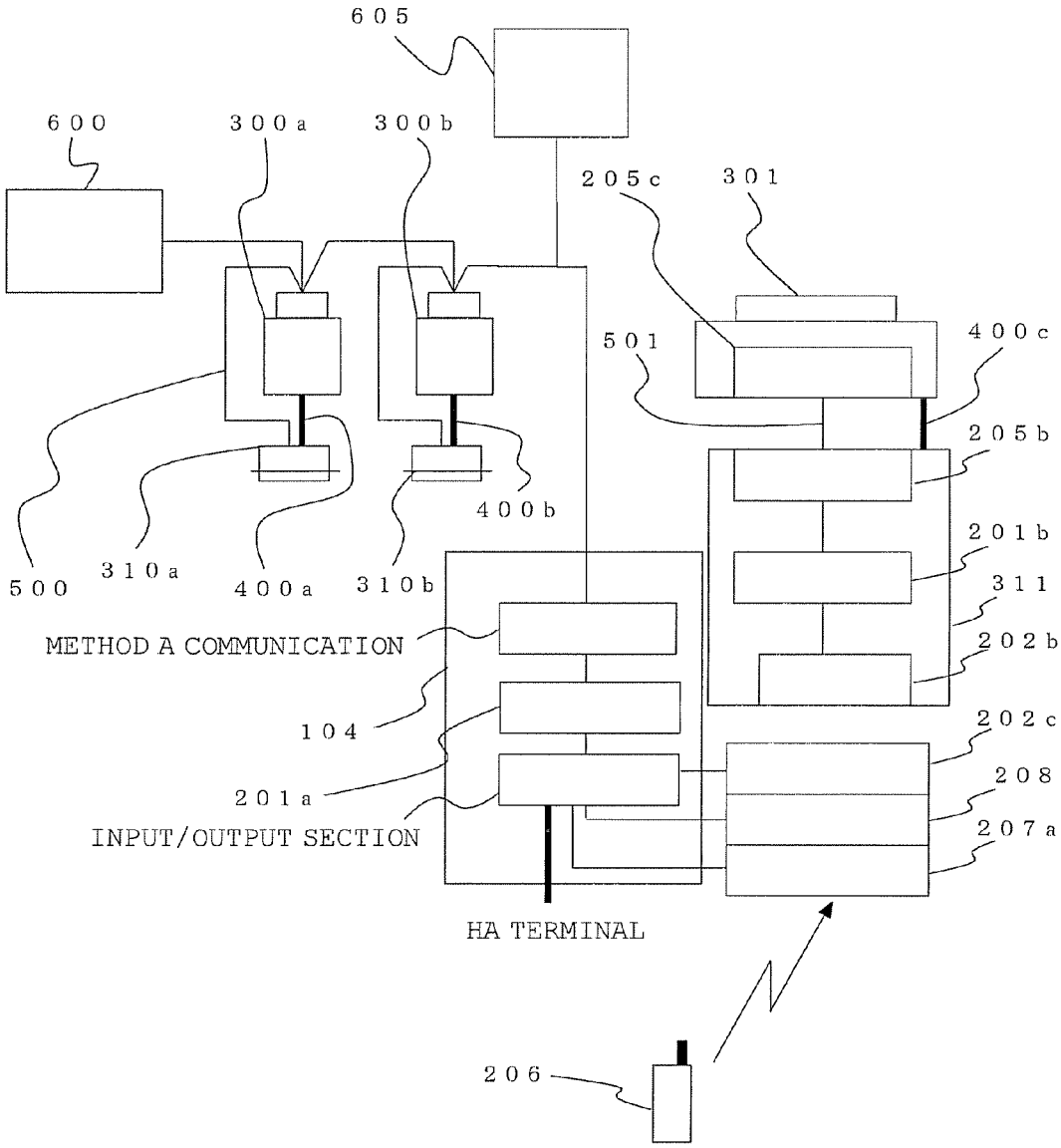
FIG. 16 is a block diagram illustrating another configuration of the equipment item management system according to the sixth embodiment of the present invention.
Figure 17:
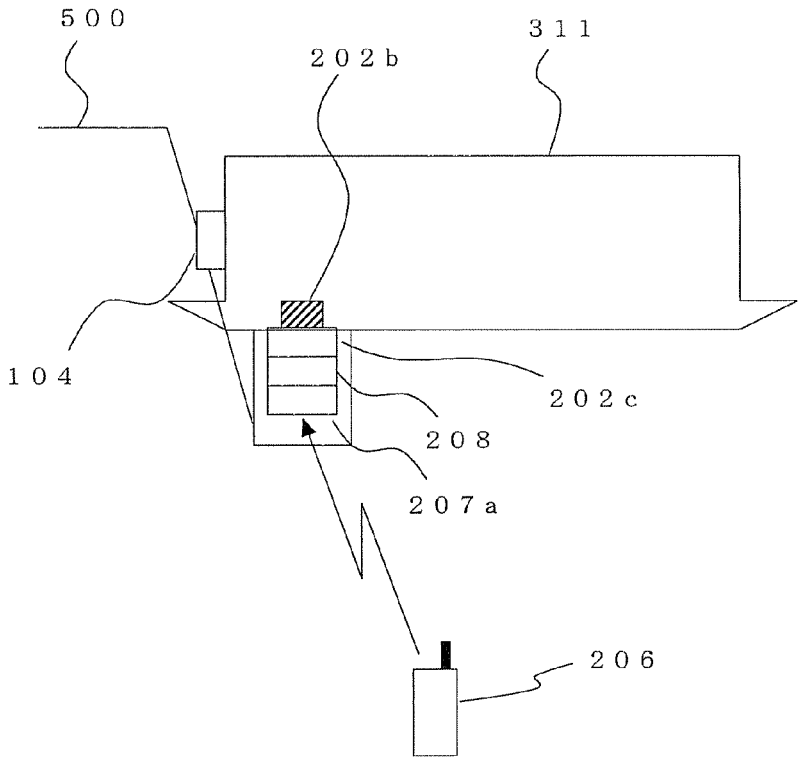
FIG. 17 is an external view of the equipment item management system in FIG. 16.

The equipment item management system may be configured as illustrated in FIG. 16. The configuration is equivalent to a configuration in which the remote control light reception section 207, the buzzer 208, and the optical communication section 202*a* are set out of the optical communication interface 103 illustrated in FIG. 14A. A photo coupler 207*a* corresponds to the remote control light reception section 207, and a light emitting diode 202*c* corresponds to the optical communication section 202*a*. An installation state in such a case is illustrated in FIG. 17. The photo coupler 207*a*, the buzzer 208, and the light emitting diode 202*c* are minute in size respectively. Accordingly, even if these elements are combined, the whole size is very small. Thus, in addition to the effects similar to above-described effects, even if the elements are mounted at a portion of the light reception section of the air conditioner, the external appearance of the air conditioner is not injured. Further, since the optical communication interface including heavier components such as the central processing section and the incoming circuit is separated, the system is light and can endure long-term attachment. Further, in the above-described embodiment, the example to perform the temperature setting using the wireless remote controller is described. However, it is possible to similarly control an ON/OFF operation of the air conditioner. Further, it is also possible to similarly control a fan control operation, a cooler/heater switching operation, a dehumidification control operation, and the like.

Seventh Embodiment

Figure 18:
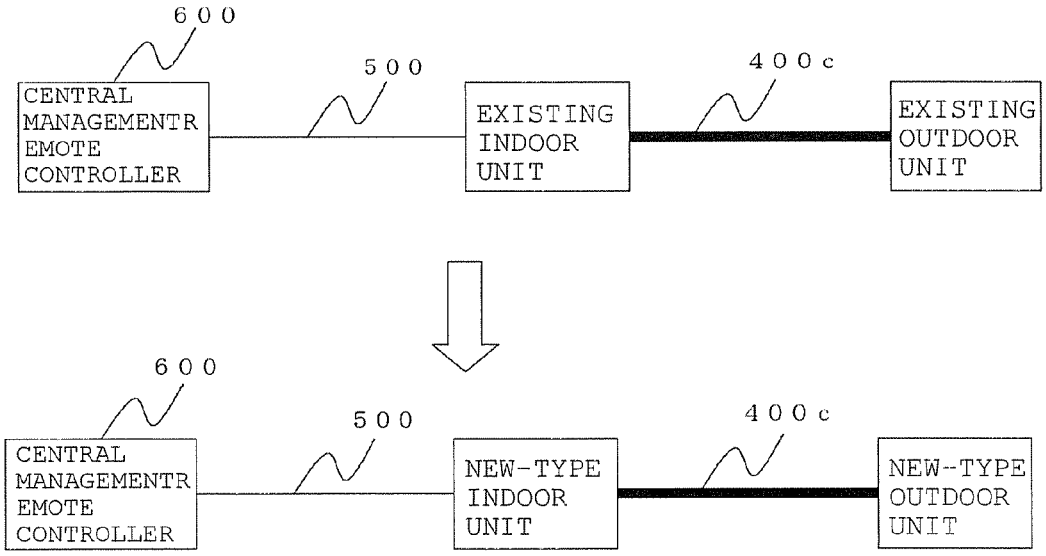
FIG. 18 is a view illustrating a replacement method according to a seventh embodiment of the present invention.

FIG. 18 is a block diagram illustrating a configuration of an equipment item management system according to a seventh embodiment of the present invention. In the seventh embodiment, in replacing an old air conditioner with a new air conditioner, an existing refrigerant line is continuously used. That is, in the replacement, in a case where the existing indoor unit and outdoor unit are discarded and replaced with a high-performance and new indoor unit and outdoor unit, an existing refrigerant line 400*c* is continuously used and the new indoor unit and the new outdoor unit are connected to the refrigerant line 400*c*. The new indoor unit is connected to a new-type central controller 600 via the communication medium 500. In a case where an existing air conditioner and a new-type air conditioner exist together and the air conditioners are centrally controlled by a new-type central controller 600, since the communication medium 500 has already configured, in the replacement, the communication medium 500 is continuously used, and the new indoor unit can be connected to the communication medium 500. Accordingly, a laying down cost of the communication medium 500 can be saved. Thus, it is possible to more inexpensively replace the equipment items than the embodiments 1 to 6.

The invention claimed is:

1. An equipment item management system comprising:

one or more first air conditioners that operate according to a first communication method;

one or more second air conditioners that operate according to a second communication method different from the first communication method and include light reception means for receiving information according to an optical communication method and means for converting the information according to the optical communication method by the light reception means into information according to the second communication method;

management means that is connected to the first air conditioner and operates according to the first communication method to manage the first air conditioner;

an interface having a first communication means configured to receive information from the management means, control means for converting the information received from the management means by the first communication means from the first communication method into the optical communication method, and light transmission means for transmitting the information converted by the control means to the second air conditioner;

wherein the management means:

identifies a manufacturer of the second air conditioner;

is connected to the second air conditioner via the interface that is connected to the management means which communicates by the first communication method; and manages the second air conditioner by transmitting a command corresponding to the manufacturer of the second air conditioner, also, that operates according to the different communication method.

2. The equipment item management system according to claim 1, wherein the management means transmits a temperature setting command to the second air conditioner via the interface.

3. The equipment item management system according to claim 2, wherein the management means transmits the temperature setting command to the first air conditioner and the second air conditioner in a case where an energy-saving control is performed.

4. The equipment item management system according to claim 1, wherein the interface includes light reception means for receiving an optical signal from a wireless remote controller, converting the received optical signal into an electric signal, and transmitting the signal to the management means.

5. The equipment item management system according to claim 1, wherein the second air conditioner includes an output terminal for outputting an operation or stop state signal, and the interface includes an input terminal that is electrically connected to the output terminal.

6. The equipment item management system according to claim 2, wherein the second air conditioner is a ceiling-mounted type air conditioner, the light transmission means is electrically connected to the control means and installed on an under surface of the air conditioner to face the optical communication means, and the control means is installed on a backside of the ceiling.

7. The equipment item management system according to claim 2, wherein the interface includes light reception means for receiving an optical signal from a wireless remote controller, converting the received optical signal into an electric signal, and transmitting the signal to the management means.

8. The equipment item management system according to claim 3, wherein the interface includes light reception means for receiving an optical signal from a wireless remote controller, converting the received optical signal into an electric signal, and transmitting the signal to the management means.

9. The equipment item management system according to claim 2, wherein the second air conditioner includes an output terminal for outputting an operation or stop state signal, and the interface includes an input terminal that is electrically connected to the output terminal.

10. The equipment item management system according claim 3, wherein the second air conditioner includes an output terminal for outputting an operation or stop state signal, and the interface includes an input terminal that is electrically connected to the output terminal.

11. The equipment item management system according to claim 4, wherein the second air conditioner includes an output terminal for outputting an operation or stop state signal, and the interface includes an input terminal that is electrically connected to the output terminal.

12. The equipment item management system according to claim 3, wherein the second air conditioner is a ceiling-mounted type air conditioner, the light transmission means is electrically connected to the control means and installed on an under surface of the air conditioner to face optical communication means, and the control means is installed on a backside of the ceiling.

13. The equipment item management system according to claim 4, wherein the second air conditioner is a ceiling-mounted type air conditioner, the light transmission means is electrically connected to the control means and installed on an under surface of the air conditioner to face optical communication means, and the control means is installed on a backside of the ceiling.

14. The equipment item management system according to claim 5, wherein the second air conditioner is a ceiling-mounted type air conditioner, the light transmission means is electrically connected to the control means and installed on an under surface of the air conditioner to face optical communication means, and the control means is installed on a backside of the ceiling.

15. The equipment item management system according to claim 1, wherein:

the interface includes a memory that stores, for different types of air conditioners, one or more commands of the first communication method, as stored command sets; and the interface selects one of the stored command sets from the memory for communication via the light transmission means.

16. The equipment item management system according to claim 15, wherein:

the memory includes a command conversion table storing the command sets such that one of the command sets is selected in advance via hardware or a memory setting.

17. The equipment item management system according to claim 1, wherein:

the interface is disposed between the first and second air conditioners such that the interface provides bi-directional conversion of communications between the first and second communication methods.

18. An equipment item management apparatus comprising:

a central controller having control means configured to:

control temperature of a first air conditioner and a second air conditioner; and identify a manufacturer of the second air conditioner; and communication means for outputting an electric signal to a network to which the air conditioners are connected based on:

a temperature set by the control means; and an interface having reception means that is connected to the network and receives the electric signal transmitted to the network, and light output means that protocol-converts the electric signal received by the reception means and outputs the converted signal in a form of a wireless optical signal as a temperature setting command, wherein the first air conditioner is connected to the network and operates according to a first communication method, the second air conditioner operates according to the wireless optical signal output by the interface corresponding to the manufacturer of the second air conditioner and different from the first communication method, and the central controller is connected to the first air conditioner via the network, and is also connected to the second air conditioner via the interface that is connected to the central controller.

19. A control method for an equipment item management system comprising:

a first air conditioner that operates according to a first communication method;

management means, which is connected to the first air conditioner, for:

communicating with the first air conditioner according to the first communication method; and managing the first air conditioner;

an interface, which is connected to the management means, for converting and transmitting the signal sent from the management means; and a second air conditioner, which is connected to the management means via the interface, including communication means for communicating according to a second communication method different from the first communication method and light reception means for receiving information according to an optical communication method, wherein the management means:

identifies a manufacturer of the second air conditioner; and transmits a temperature setting command for specifying a set temperature of the second air conditioner using the first communication method using an electric signal, the interface converts the temperature setting command from the first communication method into the optical communication method and transmits the converted command corresponding to the manufacturer of the second air conditioner to the second air conditioner, and the second air conditioner receives the temperature setting command according to the optical communication method and controls a compressor based on the received temperature setting command.

20. The control method for the equipment item management system according to claim 19, wherein the interface converts a temperature setting command according to the optical communication method received from a wireless remote controller for the second air conditioner from the optical communication method into the first communication method, and transmits the converted temperature setting command to the management means; and the management means stores a changed set temperature of the second air conditioner based on the received temperature setting command according to the first communication method.

21. The control method for the equipment item management system according to claim 20, wherein the management means includes storage means that stores a table in which priority information indicating whether to prioritize a set temperature set by the management means or prioritize the temperature setting command received from the wireless remote controller is included, determines whether to validate a received temperature setting command based on the table at the time when the management means receives the temperature setting command from the interface, and transmits the temperature setting command to the interface in a case where the management means determines to validate the temperature setting command from the interface, and when the interface receives the temperature setting command from the management means, the interface converts the received temperature setting command according to the first communication method into the optical communication method, and transmits the converted command to the second air conditioner.

22. The control method for the equipment item management system according to claim 21, wherein the interface includes a buzzer that emits an alarm sound, the management means transmits a message indicating that information of the wireless remote controller is invalidated to the interface in a case where the management means determines to invalidate the information, and the interface instructs the buzzer to output a sound indicating that the information from the wireless remote controller is invalidated.

23. The control method for the equipment item management system according to claim 19, wherein the management means sequentially transmits commands according to a plurality of optical communication methods corresponding to a plurality of types of air conditioners to the second air conditioner, receives a signal indicating an operation state of the second air conditioner from the second air conditioner, and specifies a command according to an optical communication method for controlling the second air conditioner based on the signal.

24. The control method for the equipment item management system according to claim 20, wherein the management means sequentially transmits commands according to a plurality of optical communication methods corresponding to a plurality of types of air conditioners to the second air conditioner, receives a signal indicating an operation state of the second air conditioner from the second air conditioner, and specifies a command according to an optical communication method for controlling the second air conditioner based on the signal.

25. The control method for the equipment item management system according to claim 21, wherein the management means sequentially transmits commands according to a plurality of optical communication methods corresponding to a plurality of types of air conditioners to the second air conditioner, receives a signal indicating an operation state of the second air conditioner from the second air conditioner, and specifies a command according to an optical communication method for controlling the second air conditioner based on the signal.

26. The control method for the equipment item management system according to claim 22, wherein the management means sequentially transmits commands according to a plurality of optical communication methods corresponding to a plurality of types of air conditioners to the second air conditioner, receives a signal indicating an operation state of the second air conditioner from the second air conditioner, and specifies a command according to an optical communication method for controlling the second air conditioner based on the signal.

27. The equipment item management system according to claim 23, wherein:

the management means and the second air conditioner bidirectionally communicate via light communication means such that the management means receives the signal indicating the operation state of the second air conditioner from the second air conditioner and, in response to reception of the signal indicating the operation state of the second air conditioner, the second air conditioner receives, via the light communication means from the management means, the command for controlling the second air conditioner.

* * * * *